US009896301B2

(12) United States Patent
Walker

(10) Patent No.: US 9,896,301 B2
(45) Date of Patent: Feb. 20, 2018

(54) CORD MANAGEMENT DEVICES AND METHODS

(71) Applicant: Stitch House, LLC, Upper Arlington, OH (US)

(72) Inventor: Raymond M. Walker, Columbus, OH (US)

( * ) Notice: Subject to any disclaimer, the term of this patent is extended or adjusted under 35 U.S.C. 154(b) by 239 days.

(21) Appl. No.: 14/926,414

(22) Filed: Oct. 29, 2015

(65) Prior Publication Data

US 2016/0122154 A1 May 5, 2016

Related U.S. Application Data

(60) Provisional application No. 62/072,154, filed on Oct. 29, 2014.

(51) Int. Cl.

| | |
|---|---|
| ***B65H 75/28*** | (2006.01) |
| ***B65H 75/44*** | (2006.01) |
| ***H01R 13/72*** | (2006.01) |

(52) U.S. Cl.

CPC ..... *B65H 75/285* (2013.01); *B65H 75/28* (2013.01); *B65H 75/4473* (2013.01); *H01R 13/72* (2013.01); *B65H 2701/34* (2013.01); *B65H 2701/3919* (2013.01)

(58) Field of Classification Search

CPC .. B65H 75/285; B65H 75/4473; B65H 75/28; B65H 2701/34; B65H 2701/3919; H01R 13/72

See application file for complete search history.

(56) References Cited

U.S. PATENT DOCUMENTS

| | | | | |
|---|---|---|---|---|
| 4,802,638 | A * | 2/1989 | Burger | B65H 75/143 242/388.1 |
| 6,059,213 | A * | 5/2000 | Phillips | B65H 75/44 191/12.4 |
| 7,610,661 | B2 * | 11/2009 | Sween | B65H 75/06 24/129 R |
| 7,677,920 | B2 * | 3/2010 | Huang | H01R 13/72 439/501 |
| 8,523,098 | B2 * | 9/2013 | Detweiler | B65H 75/28 242/400.1 |
| 8,646,718 | B2 * | 2/2014 | Spencer | B65H 75/28 242/379 |
| 9,143,852 | B2 * | 9/2015 | Demier | H04R 1/1033 |
| 9,340,341 | B2 * | 5/2016 | Farrell | B65D 63/14 |
| 9,813,797 | B2 * | 11/2017 | Abfall | H04R 1/1033 |

(Continued)

*Primary Examiner* — Robert Sandy
*Assistant Examiner* — Louis A Mercado

(57) ABSTRACT

A cord spool may have a generally cylindrical primary element made of flexible material, which may have first and second primary element openings. The primary element may further include a central exterior portion between first and second raised portions. The primary element may further include an interior portion dimensioned and configured to accept a fixture. The cord spool also may have at least one flexible strap securely affixed to and extending through the interior portion of the primary element and extending beyond the first and second openings of the primary element. The strap may have first and second strap ends with first and second fasteners. The strap may be dimensioned and configured to allow the first and second strap ends to be releasably secured to one another, forming a cord securing loop.

16 Claims, 8 Drawing Sheets

(56) References Cited

U.S. PATENT DOCUMENTS

| | | | | |
|---|---|---|---|---|
| 2007/0020993 | A1* | 1/2007 | Symons | H01R 13/72<br>439/501 |
| 2012/0128193 | A1* | 5/2012 | Stevinson | H04R 1/1033<br>381/384 |
| 2013/0134252 | A1* | 5/2013 | Cheng | H01R 13/60<br>242/405.1 |
| 2013/0301864 | A1* | 11/2013 | Glaser | H04R 1/1033<br>381/380 |
| 2016/0037250 | A1* | 2/2016 | Hildebrandt | H04R 1/1033<br>242/580 |
| 2016/0204560 | A1* | 7/2016 | Rodriguez | B65H 75/28<br>242/587 |

* cited by examiner

CORD MANAGEMENT DEVICES AND METHODS

CROSS-REFERENCE TO RELATED APPLICATION

This Non-Provisional Patent Application claims priority to and claims the benefit of U.S. Provisional Patent Application Ser. No. 62/072,154, entitled "Wearable Cord Spool," filed Oct. 29, 2014, which is incorporated by reference in its entirety as if fully set forth herein.

FIELD

The described apparatus and method generally relate to the field of cord management, more specifically, devices and methods for storing and accessing cords.

BACKGROUND AND SUMMARY

A need exists for a more convenient and effective means for managing cords of various kinds and sizes. The term "cord" as used herein may be read to include any relatively long, thin, flexible cord-like material. For example, wires, electric cords, extension cords, string, rope, strand, tubing, twisted fiber, belts, or similar such relatively long, thin, flexible cord-like materials of various sizes and for various uses.

An example of a particular need is to manage the cords of devices. For example, the wires of electronic devices such headphones (including in-ear headphones such as "earbuds" and over the ear style headphones), speakers, microphones, mobile phones, tablets, portable music players, laptops, computers, stereos, television, internet, audio/visual, and entertainment equipment, etc.

While the words "device", "peripheral device," "electronic device", and "plug" are used herein, the invention is not limited to any particular such devices. Also, the term "device" may be generally used herein to refer to all of the above kinds of devices and others, whether or not electronic, unless a specific kind of device is recited.

The cord spools and methods disclosed herein provide a more convenient and effective means for managing cords by allowing the user to easily wrap the cord around the cord spool. The cord spools allow a user to secure the cord to the cord spool by using straps of the cord spool. Cord spools may include device cord spools, including electronic device cord spools. In some embodiments, cord spools may be wearable on a user's person or may, in the alternative, be dimensioned, configured, or used without being worn on the user's person.

In one embodiment, a cord spool may have a generally cylindrical primary element made of flexible material, which may have first and second primary element openings. The primary element may further include a central exterior portion between first and second raised portions. The primary element may further include an interior portion dimensioned and configured to accept a fixture.

The cord spool also may have at least one flexible strap securely affixed to and extending through the interior portion of the primary element and extending beyond the first and second openings of the primary element. The strap may have first and second strap ends with first and second fasteners. The strap may be dimensioned and configured to allow the first and second strap ends to be releasably secured to one another, forming a cord securing loop.

The cord spool also may have at least one cord end receiving loop securely affixed to one of the first or second raised portions.

The cord spool may be dimensioned and configured to permit a cord of a device to be wound around the central exterior portion of the primary element, to be secured by the strap, and an end of the cord to be secured by the cord end receiving loop.

In some embodiments, a cord spool may include a first cord end receiving loop securely affixed to the first raised portion of the primary element, wherein the first cord end receiving loop is dimensioned and configured to secure a first type of cord end. In some embodiments, a cord spool may include a second cord end receiving loop securely affixed to the second raised portion of the primary element, wherein the second cord end receiving loop is dimensioned and configured to secure a second type of cord end. Examples of cord ends for electronic devices may include a straight jack, a right-angle jack, cord ends for USBs, device charging plugs, power outlet plugs, and other cord ends now known or after arising.

In some examples, the cord spool may also include a device receiving sleeve securely affixed to one of the first or second primary element openings. The device receiving sleeve may be made of flexible elastic material and be dimensioned and configured to releasably secure a device, for example, by friction.

In some examples, the device cord spool may be dimensioned and configured to permit a device to be held in the receiving sleeve while a cord is plugged into the device with the cord extending from the device, though the interior of the primary element, wound around the central exterior portion of the primary element, and held in place by the strap.

In some examples of a device cords spool with a device receiving sleeve, the device, as inserted into the receiving sleeve rather than the primary element, may serve as the fixture during the wrapping of the cord around the central exterior portion of the primary element.

In some examples, the cord spool is dimensioned and configured such that it is capable of being used without a fixture.

DETAILED DESCRIPTION

Figure 1:
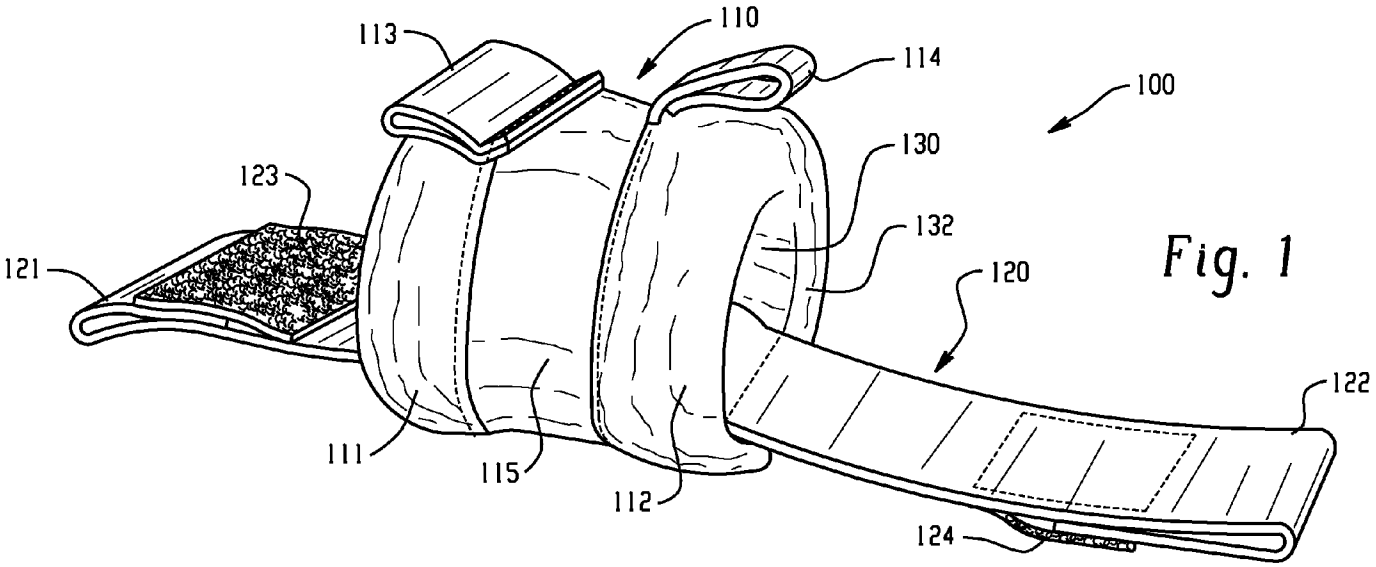
FIG. 1 is a perspective view of a cord spool.
Figure 2:
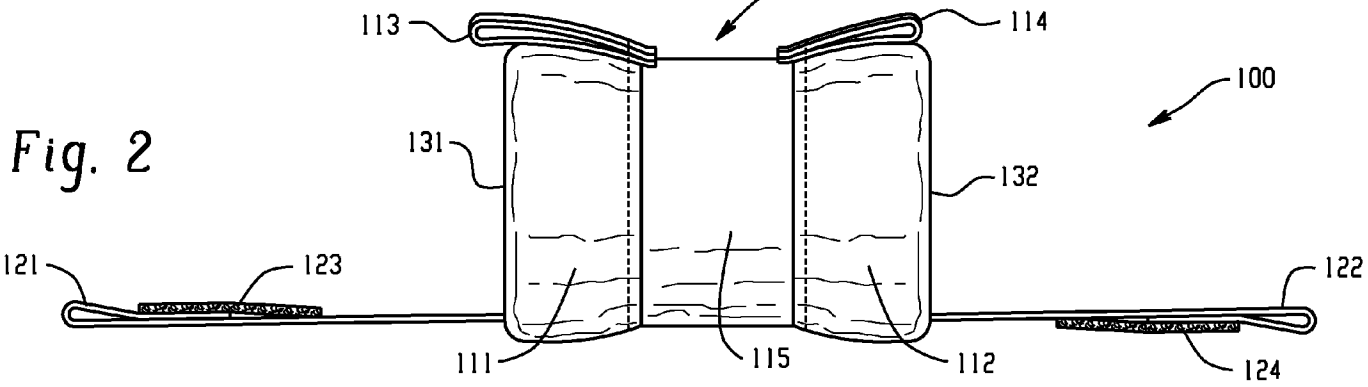
FIG. 2 is a side view of a cord spool.
Figure 3:
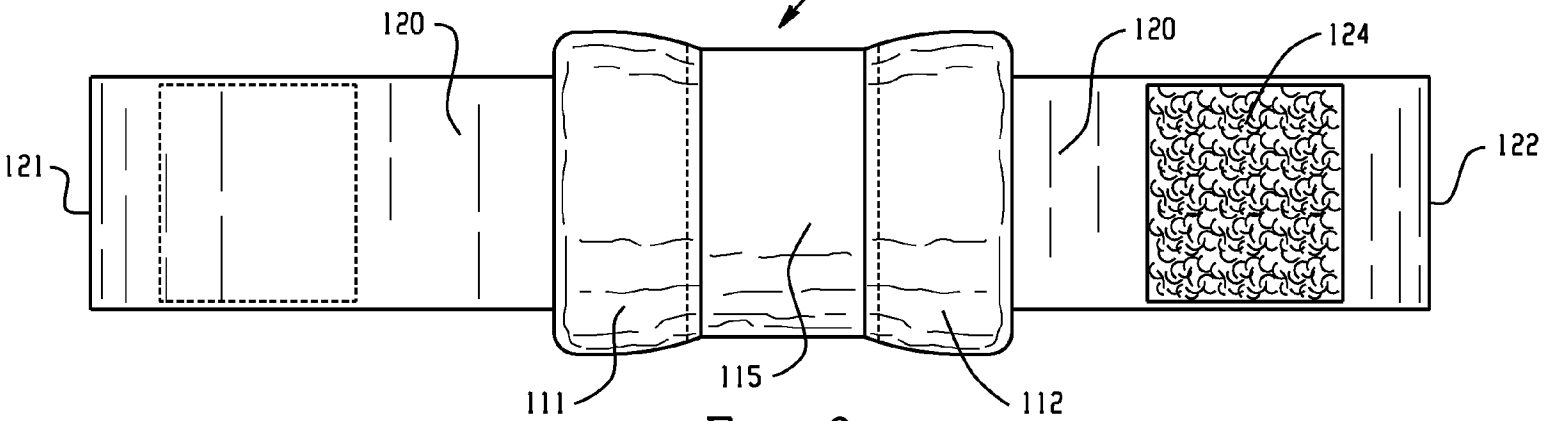
FIG. 3 is a bottom view of a cord spool.
Figure 4:
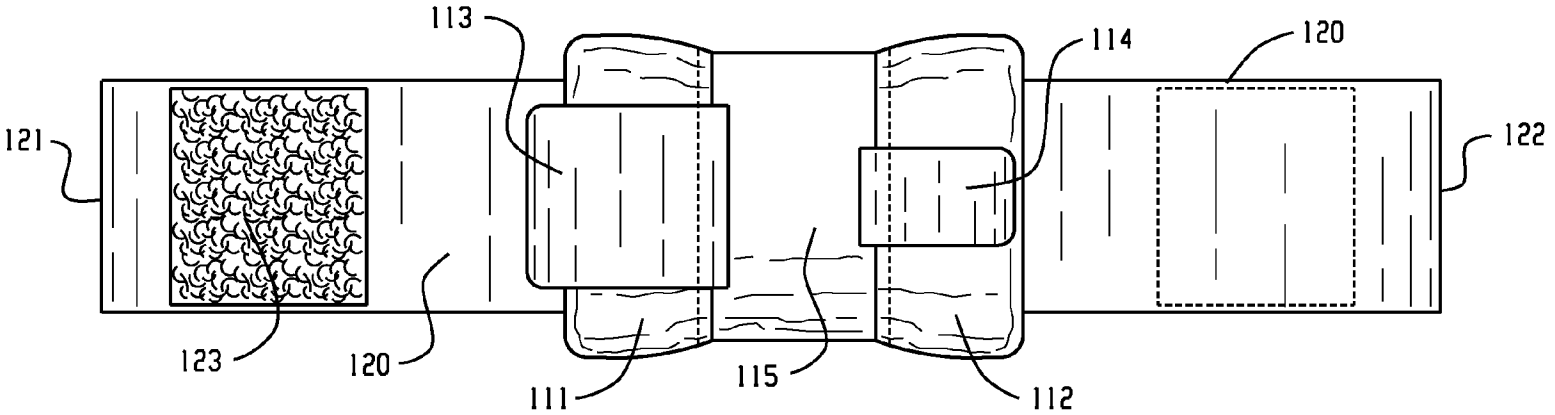
FIG. 4 is a top view of a cord spool.

The apparatuses and methods disclosed and described in this document are described in detail with reference to the views and examples of the included figures. Those of ordinary skill in this art will recognize that modifications to disclosed and described components, elements, methods, materials, and so forth can be made and can be desired for a specific application.

As shown in the different views provided by FIGS. 1-6, a cord spool 100 is shown. Depending on the particular application, cord spools such as disclosed in these drawings can be dimensioned and configured with differing sizes and features. As shown in the particular example of FIGS. 1-6, the cord spool 100 includes a generally cylindrical primary element 110 made of flexible material. The primary element 110 can have first and second primary element openings, 131 and 132, respectively. The primary element 110 can further include a central exterior portion 115 between first and second raised portions, 111 and 112 respectively. The primary element 110 can also have an interior portion 130 dimensioned and configured to accept a fixture (not shown).

The cord spool 100 shown in FIGS. 1-6 can be dimensioned and configured to permit a cord (not shown) to be wound around the central exterior portion 115 of the primary element 110, to be secured by the strap 120, and an end of the cord to be secured by one of the cord end receiving loops 113 or 114.

Embodiments of the cord spool 100 can be dimensioned and configured to accept any fixture suitable for holding the cord spool 100 in place while a user winds a cord around the primary element 110 and wherein the interior portion 130 of the primary element 110 is dimensioned and configured to accept the fixture.

For example, in some embodiments of wearable cord spools, a cord spool 100 may be have a primary element that is dimensioned and configured to accept a body part of the user such as, for example, one, two, three, or more fingers.

In one particular example, a wearable electronic device cord spool can be dimensioned and configured to be worn by the user on the user's finger. The wearable electronic device cord spool can be further dimensioned and configured to permit the user to wind the cord around the central portion of the primary element while the user's finger is inserted into the interior portion of the primary element. Similarly, a wearable electronic device cord spool can be dimensioned and configured to accept two, three, or more fingers.

In other embodiments, a wearable electronic device cord spool may be have a primary element that is dimensioned and configured to accept and fit around fixtures other than the user's finger. For example, embodiments could have primary elements dimensioned and configured to fit around a hand, two hands, an arm, two arms, a leg, two legs, a torso, a head, or virtually any other body part of a human or other animal that is suitable for the particular cord in need of management.

In other examples, the primary element can be dimensioned and configured to accept and fit around any other suitable fixture. For example, a pole, post, lamp stem, door knob, table leg, etc. In some embodiments, not depicted in the drawings, the primary element may be detachable along its length, such that the primary element can be opened, wrapped around a fixture , the length-wise edges of the primary element re-attached to secure the primary element around the fixture, and then the cord spool used to manage a cord.

In other examples, the fixture may be the device itself. In some examples, the device may be inserted into the primary element and the cord of the device connected to the cord while the cord is wrapped around the primary element.

In some examples of use, the user may optionally not insert any fixture into the device cord spool and instead simply grasp the spool itself while winding and unwinding the cord.

As is further shown in FIGS. 1-6, a cord spool 100 can have at least one flexible strap 120 securely affixed to and extending through the interior portion 130 of the primary element 110 and extending beyond the first and second openings, 131 and 132 respectively, of the primary element 110. The strap 120 can have first and second strap ends, 121 and 122 respectively, with first and second fasteners, 123 and 124, respectively.

Figure 6:
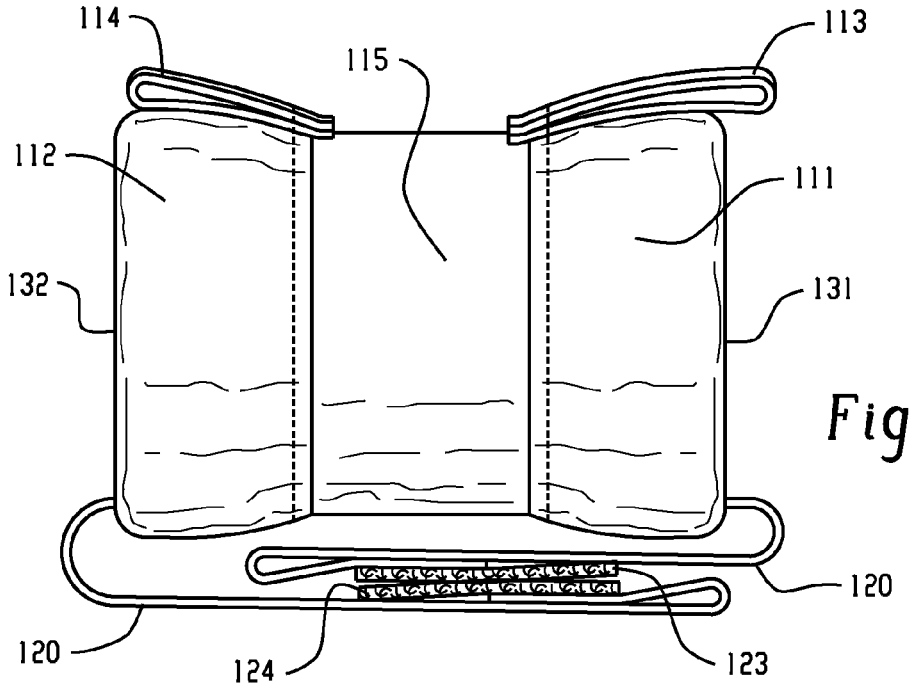
FIG. 6 is a side view of a cord spool.

The strap 120 can be dimensioned and configured to allow the first and second strap ends 121 and 122 to be releasably secured to one another, forming a cord securing loop, as depicted in FIG. 6.

Figure 5:
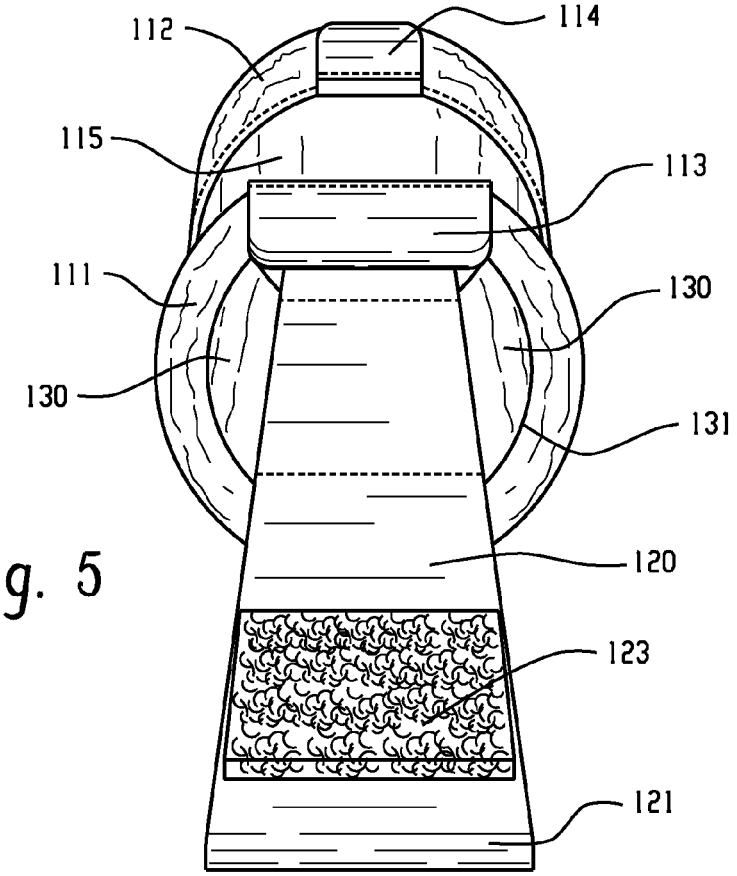
FIG. 5 is a perspective view of a cord spool.

In some embodiments, rather than a single strap 120 running through the interior portion 130 of the primary element 110 as shown in FIG. 5, the cord spool 100 may instead include two separate straps: a first strap attached to the first primary element opening and a second strap attached to the second primary element opening.

The fasteners 123 and 124 may be any suitable mechanical or chemical means of releasably securing the strap ends 121 and 122, now known or after arising. For example, the fasteners 123 and 124 may be fabric hook and loop fasteners such as Velcro® brand fasteners, as depicted in FIGS. 1-6. Alternatively, the fasteners could be buttons, snaps, clasps, zippers, magnets, or any other suitable fastening means.

As is further shown in the example provided in FIGS. 1-6, the cord spool 100 can include one or more cord end receiving loops. In this example, a first cord end receiving loop 113 is shown attached to the first raised portion 111 and a second cord end receiving loop 114 is shown attached to the second raised portion 112.

In some embodiments, a cord spool may be made of soft goods materials. In some embodiments, the flexible material of the primary element is resilient. For example, the primary element may be made of cushioned fabric. In some embodiments, the primary element is made of Polychloroprene (Neoprene) or other fabrics, foam, leather, or rubber. In some embodiments, the raised portions of the primary elements may include internal elastic cord or vinyl tubing to define the shape of the raised portions. In some embodiments, the strap or straps are made of elastic webbing. In some embodiments, the receiving loop or receiving loops are made of elastic webbing. In the examples of cord spools made of soft goods materials, the cord spools may be crushable for ease of storage.

In alternative examples, portions of the cord spool 100 may be made of hard materials such as plastic or metal. For example, the central exterior portion of the primary element may be made of hard materials in order to facilitate the use of the spool with particular types of cords.

Various components of the cord spool 100 can be securely affixed by any suitable mechanical or chemical means now know or after arising. For example, the strap or straps, the raised portions, the fasteners, the cord end receiving loops, and/or the device receiving sleeve can be affixed by sewing them in place. Other fastening means can also be used in some examples, such as, for example, glue.

Figure 7:
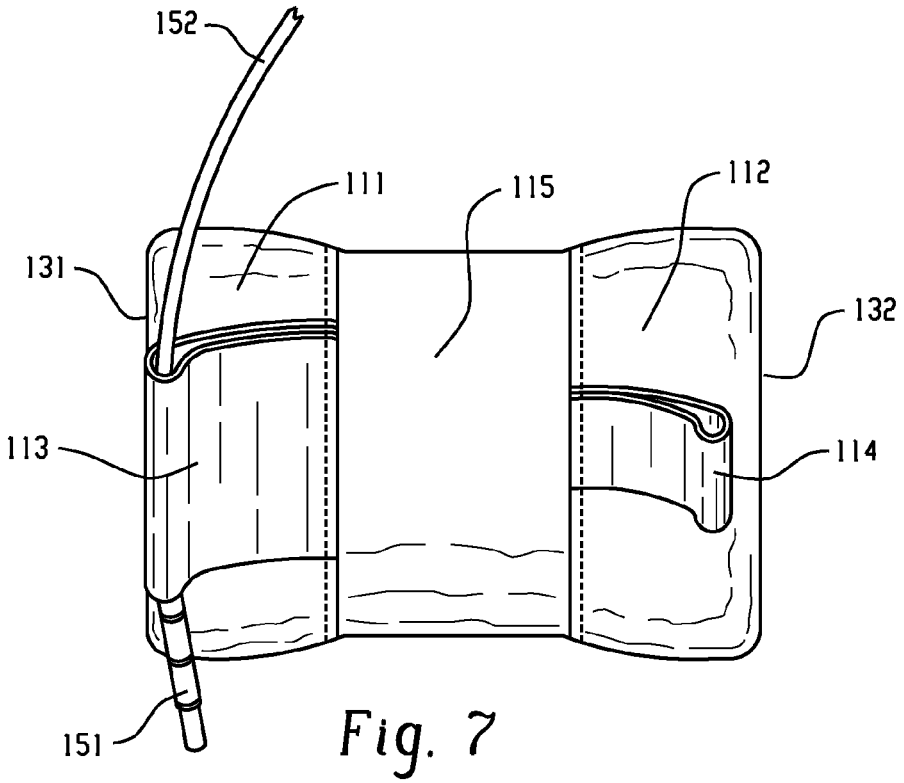
FIG. 7 is a top view of a cord spool shown with a straight jack cord end.
Figure 8:
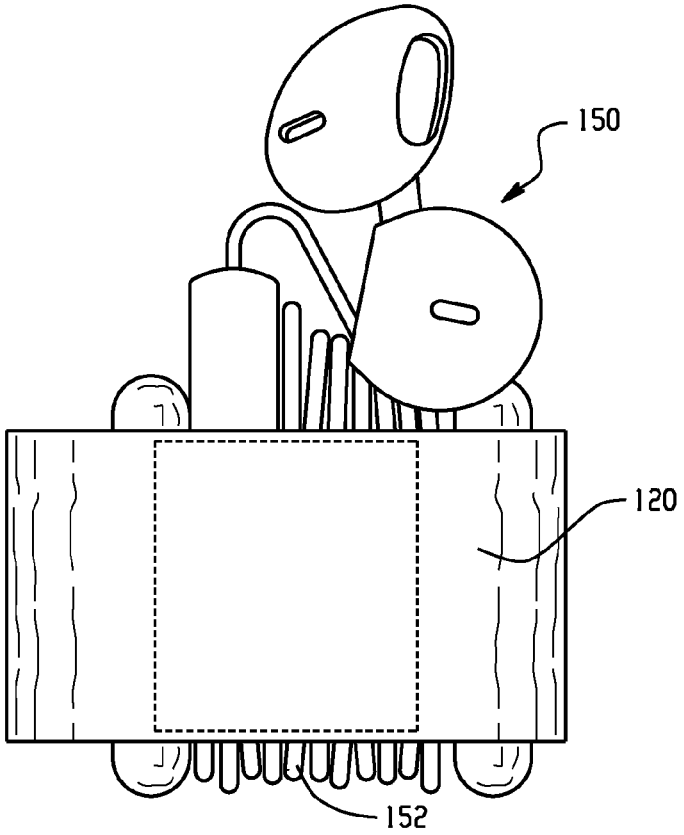
FIG. 8 is a bottom view of a cord spool shown with secured earphones.

Turning now to the examples shown in FIGS. 7-10, a cord spool is shown in use with electronic devices having different kinds of cord ends. In FIG. 7, the first receiving loop 113, which can be attached to the first raised portion 111, can be dimensioned and configured to hold a straight jack style cord end 151 of a cord 152 of a pair of headphones 150. As shown in FIGS. 7-8, the cord 152 can be wrapped around the central exterior portion 115 and secured by the strap 120.

Figure 9:
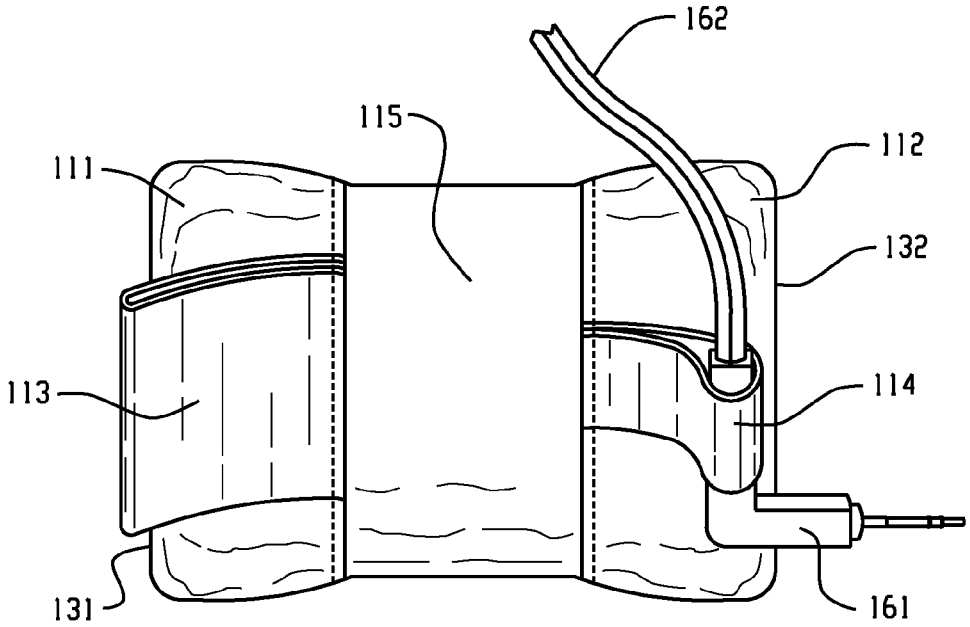
FIG. 9 is a top view of a cord spool shown with a right-angle jack cord end.
Figure 10:
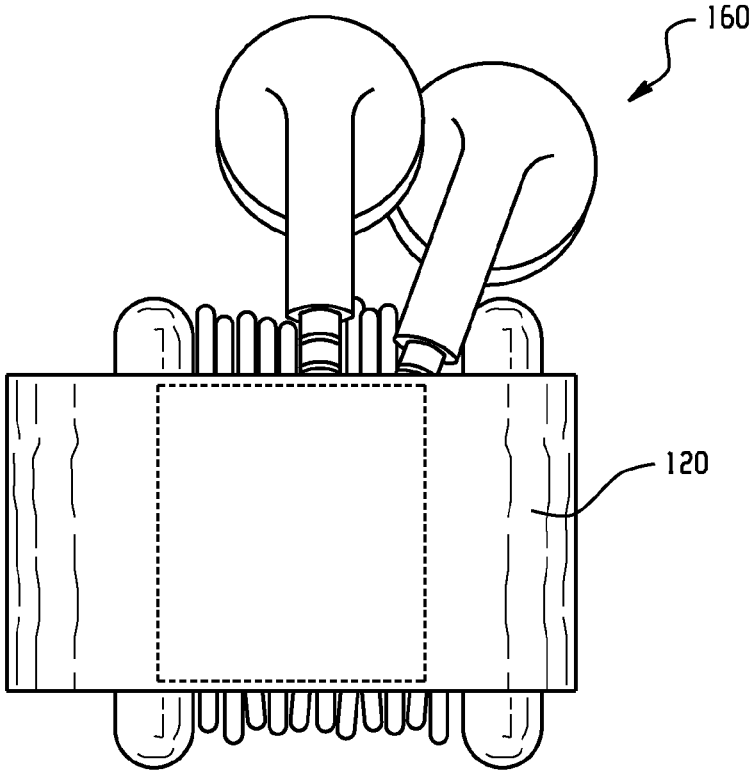
FIG. 10 is a bottom view of a cord spool shown with secured earphones.

Similarly, in the example of FIG. 9, the second receiving loop 114 can be attached to the second raised surface 112 and can be dimensioned and configured to hold a right-angle jack style cord end 161 of a cord 162 of a pair of headphones 160. As shown in FIGS. 9-10, the cord 162 can be wrapped around the central exterior portion 115 and secured by the strap 120. Receiving loops can likewise be dimensioned and configured to hold other kinds of cord ends.

Figure 11:
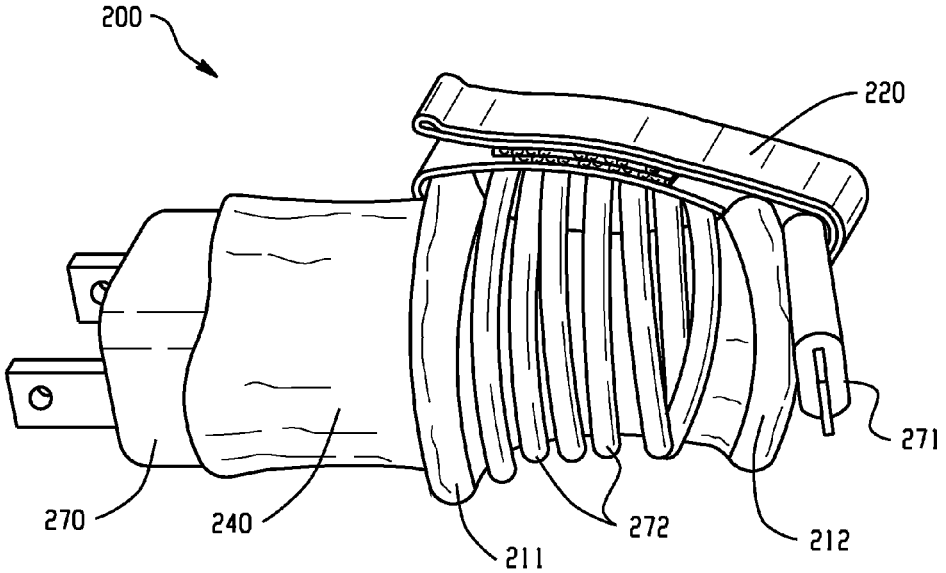
FIG. 11 is a perspective view of a cord spool with power plug and power cord.
Figure 12:
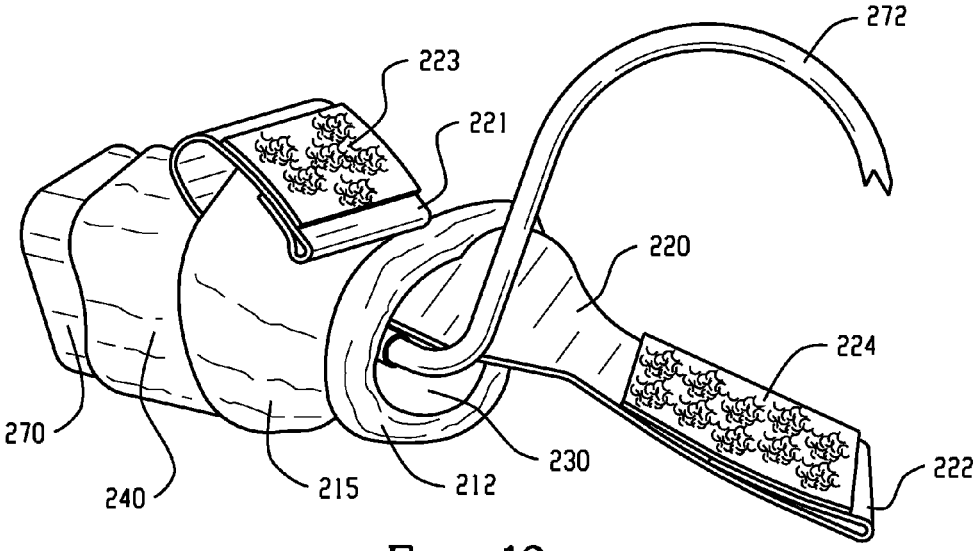
FIG. 12 is a perspective view of a cord spool with power plug and power cord.
Figure 13:
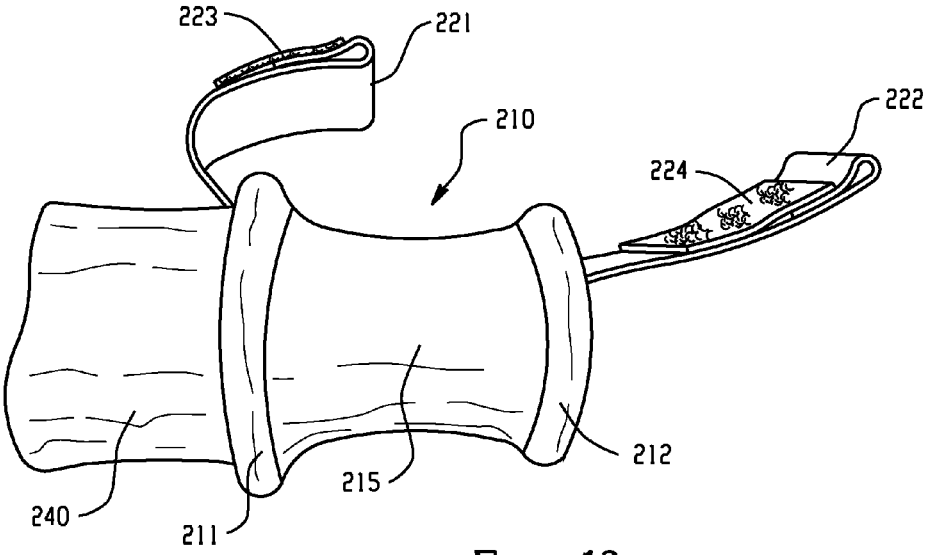
FIG. 13 is a side view of a cord spool.

Turning now to the example shown in FIGS. 11-13, a cord spool 200 can include a device receiving sleeve 240, in addition to the primary element 210. The device receiving sleeve 240 can be dimensioned and configured to secure a device, such the power plug 270 shown in FIG. 11.

In some examples, the device receiving sleeve can be made of flexible, elastic material. Any other material now known or after arising that is suitable for securing an intended device and allowing the device to be removed can be used.

In this example, the cord spool 200 also has a primary element 210, including a central exterior portion 215 and first and second raised portions, 211 and 212. As also shown, a first strap end 211 with a first strap end fastener 223 and a second strap end 222 with second strap end fastener 224 can be included.

As depicted in the examples of FIGS. 11-13, the power plug 270 can be inserted into the device receiving sleeve 240 and the power cord 272, with power cord end 271, can be wrapped around the central exterior portion 215 and secured by a cord receiving loop formed by the joining of strap ends 221 and 223 by fasteners 223 and 224. As shown in FIG. 12, the power cord 272 may pass through an interior portion 230 of the primary element 210, allowing the power cord 272 to remain plugged into the power plug 270, while the power cord 272 is wrapped around the central exterior portion 215 and secured by the strap 220.

In the example of FIGS. 11-13, a user may insert a fixture, such as the user's finger, into the interior portion 230 of the primary element 210 while wrapping the cord 272. Alternatively, in some examples, the user may grasp the device receiving sleeve 240 and/or the device being held in the device receiving sleeve 240, such as the power plug 270 shown in the figures. In such embodiments, the device receiving sleeve 240 can be dimensioned and configured to hold the device firmly in place during the wrapping of the cord, such that the device in the receiving sleeve becomes the fixture.

Figure 14:
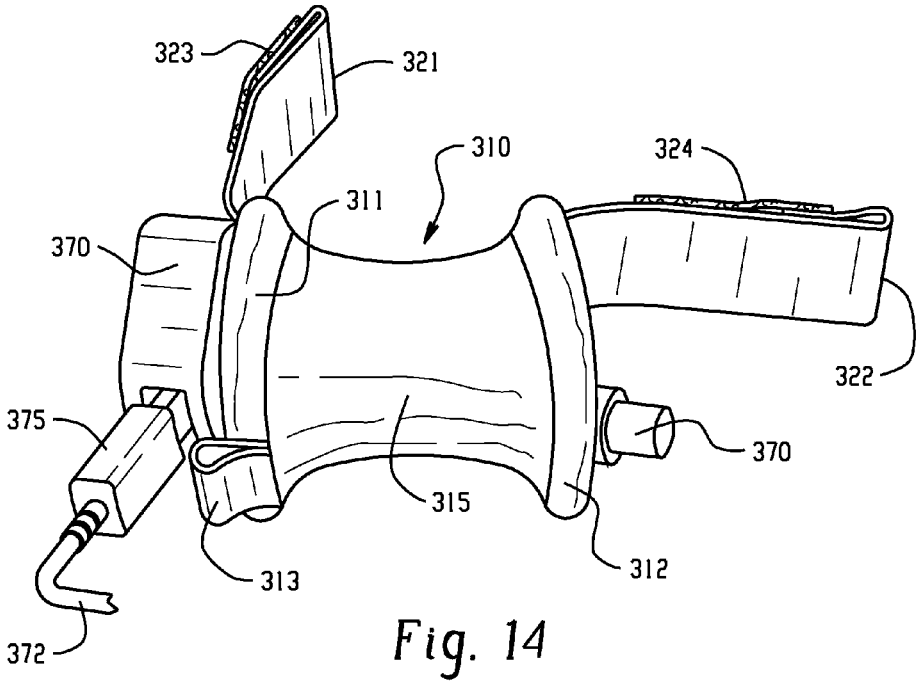
FIG. 14 is a perspective view of a cord spool with a power plug.
Figure 15:
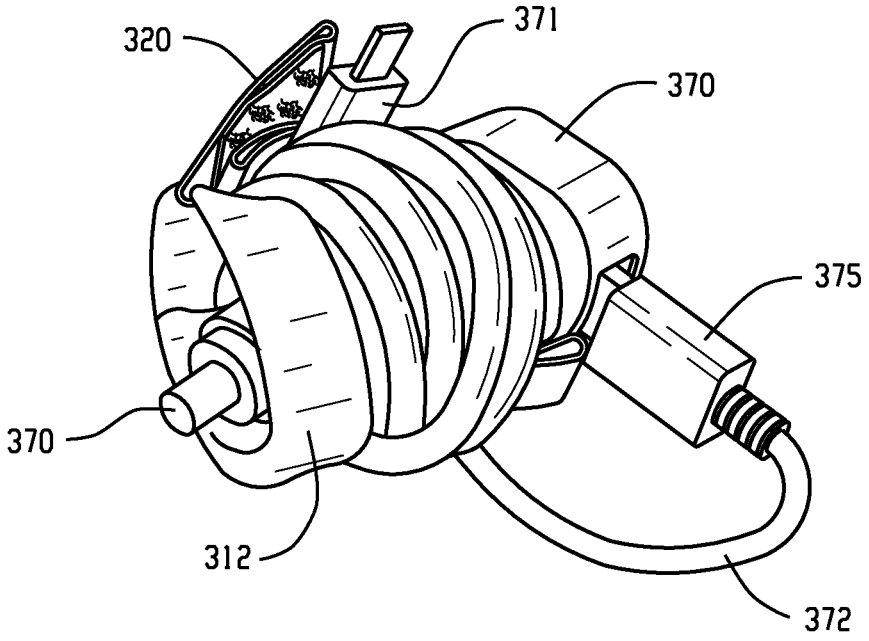
FIG. 15 is a perspective view of a cord spool with a power plug.

Turning now to the example of FIGS. 14-15, a cord spool is shown dimensioned and configured to secure a device by using the device itself as the fixture. In this example, an AC Adapter power plug 370 is shown as the exemplary device. The plug has a power cord 372, which connects to a power cord 372, which has a cord connector 375 and a cord end 371.

In this example, the plug 370 is inserted through the interior portion of the primary element 310. With the plug 370 serving as the fixture, the cord 372 can be wound around the central exterior portion 315, located between the first and second raised portions 311 and 312. The first and second strap ends 321 and 322 can be joined by first and second fasteners 323 and 324 to secure the cord 372. The cord end 372 can be optionally secured in a cord end receiving loop 313.

In connection with the above described embodiments of cord spools, several methods of managing cords are made possible. For example, a method of managing device cords may include the following steps. A first cord end of a cord of a device may be inserted into one of a first or a second cord receiving loop of a device cord spool. A fixture may be inserted into an interior portion of the device cord spool. The cord can be wrapped around a central exterior portion of the device cord spool. First and second ends of a flexible strap of the device cord spool may be wrapped around the cord and the ends fastened to one another to secure the cord for storage.

When the user wishes to access the cord, the user can unfasten the first and second ends of the flexible strap and pull on a second cord end of a cord of the device to unspool the cord for use. If the device cord spool was optionally removed from the fixture after cord storage, the user can optionally re-insert the fixture prior to unspooling the cord.

In some examples, the user can use his own body part as the fixture. For example, and as discussed above, the user can insert his finger into the interior portion of the primary element of the device cord spool. In other examples, as discussed above, other fixtures could be utilized. As is also discussed above, the user could utilize the device itself, in some examples, as the fixture.

In other examples of use, the user may optionally not insert any fixture into the interior portion of the primary element or into the device receiving sleeve and may instead simply grasp the spool itself while winding or unwinding the cord around the spool.

In some examples, the cord spool may be worn by the user in the period between storage and use of the cord. In other examples, the user can remove the cord spool after securing the cord and then re-install the cord on his person when ready to access the cord by unwinding it from the spool.

In this disclosure, any identification of specific shapes, materials, techniques, and the like are either related to a specific example presented or are merely a general description of such a shape, material, technique, or the like. Identifications of specific details are not intended to be and should not be construed as mandatory or limiting unless specifically designated as such. Selected examples of cord management devices and methods of use are disclosed and described in detail below. It should be noted that those may have an ordinary level of skill in this area will recognize from reading this disclosure that various components of the disclosed apparatuses can be combined in ways not specifically shown in the examples to create an additional specific configuration. For ease of understanding and readability, no attempt is made to catalog every possible combination of the disclosed components.

Numerical ranges and parameters set forth approximations of the broad scope of the disclosed systems and methods. The numerical values set forth in the specific examples, are reported as precisely as possible. Any numerical value, however, inherently contains certain errors necessarily resulting from the standard deviation found in their respective testing measurements.

Furthermore, while the devices, systems, methods, and so on have been illustrated by describing examples, and while the examples, have been described in considerable detail, it is not the intention of the applicant to restrict, or in any way, limit the scope of the appended claims to such detail. It is, of course, not possible to describe every conceivable combination of components or methodologies for purposes of describing the devices, systems, methods, and so on provided herein. Additional advantages and modifications will readily appear to those skilled in the art. Therefore, the invention, in its broader aspects, is not limited to the specific details and illustrative examples, shown and described. Accordingly, departures can be made from such details without departing from the spirit or scope of the applicant's general inventive concept. Thus, this application is intended to embrace alterations, modifications, and variations that fall within the scope of the appended claims. The preceding description is not meant to limit the scope of the invention. Rather, the scope of the invention is to be determined by the appended claims and their equivalents.

Directional terms such as "up", "down", "left", "right", "over", "top", "bottom," "side", and "around" are meant to reference the representations shown in figures and are not meant to restrict the particular arrangement of the various elements in the claimed apparatus or method.

Finally, to the extent that the term "includes" or "including" is employed in the detailed description or the claims, it is intended to be inclusive in a manner similar to the term "comprising," as that term is interpreted when employed as a transitional word in a claim. Furthermore, to the extent that the term "or" is employed in the claims e.g., A or B it is intended to mean "A or B or both." When the applicant intends to indicate "only A or B, but not both," then the term "only A or B but not both" will be employed. Similarly, when the applicant intends to indicate "one and only one" of A, B, or C, the applicant will employ the phrase "one and only one." Thus, use of the term "or" herein is the inclusive, and not the exclusive use.

What is claimed is:

1. A wearable electronic device cord spool, comprising a generally cylindrical primary element made of flexible material having first and second primary element openings, the primary element further including a central exterior portion between first and second raised portions, wherein the primary element has an interior portion dimensioned and configured to accept a fixture that is part of a user's body;

at least one flexible strap securely affixed to and extending through the interior portion of the primary element and extending beyond the first and second openings of the primary element, the strap having first and second strap ends with first and second fasteners, the strap dimensioned and configured to allow the first and second strap ends to be releasably secured to one another, forming a cord securing loop;

at least one cord end receiving loop securely affixed to one of the first or second raised portions; and wherein the wearable electronic device cord spool is dimensioned and configured to permit a cord of a device to be wound around the central exterior portion of the primary element, to be secured by the strap, and an end of the cord to be secured by one of the at least one cord end receiving loops.

2. The electronic device cord spool of claim 1 in which the wearable electronic device cord spool is made of soft goods materials.

3. The electronic device cord spool of claim 2 wherein the fixture comprises at least one finger of the user and wherein the device cord spool is dimensioned and configured to be worn by the user on the at least one finger and to permit the user to wind the cord around the central portion of the primary element while the finger is inserted into the interior portion of the primary element.

4. The wearable electronic device cord spool of claim 3 comprising a first cord end receiving loop securely affixed to the first raised portion of the primary element, wherein the first cord end receiving loop is dimensioned and configured to secure a first type of cord end; and a second cord end receiving loop securely affixed to the second raised portion of the primary element, wherein the second cord end receiving loop is dimensioned and configured to secure a second type of cord end.

5. The wearable electronic device cord spool of claim 4 in which the cord is earphone wires and the first type of cord end is a straight jack.

6. The wearable electronic device cord spool of claim 4 in which the cord is earphone wires and the second type of cord end is a right-angle jack.

7. The wearable electronic device cord spool of claim 2 further comprising a device receiving sleeve securely affixed to one of the first or second primary element openings, the device receiving sleeve made of flexible elastic material and being dimensioned and configured to releasably secure a device; and wherein the wearable device cord spool is dimensioned and configured to permit a device to be held in the receiving sleeve while a cord is plugged into the device with the cord extending from the device, though the interior of the primary element, wound around the central exterior portion of the primary element, and held in place by the strap.

8. The wearable device cord spool of claim 7 wherein the device is a charger plug.

9. The wearable device cord spool of claim 8 wherein the charger plug has a generally cylindrical portion and wherein the receiving sleeve is dimensioned and configured to fit around the cylindrical portion of the charger plug.

10. The wearable device cord spool of claim 9 wherein the charger plug has a generally box-shaped portion and wherein the receiving sleeve is dimensioned and configured to fit around the box-shaped portion of the charger plug.

11. The wearable device cord spool of claim 2 in which cord is a power cable.

12. The wearable device cord spool of claim 2 in which cord is an electric extension cord.

13. A device cord spool, comprising a generally cylindrical primary element made of flexible material having first and second primary element openings, the primary element further including a central exterior portion between first and second primary element raised portions, wherein the primary element has an interior portion dimensioned and configured to accept a portion of a device;

at least one flexible strap securely affixed to and extending through the interior portion of the primary element and extending beyond the first and second openings of the primary element, the strap having first and second strap ends with first and second fasteners, the strap dimensioned and configured to allow the first and second strap ends to be releasably secured to one another, forming a cord securing loop;

at least one cord end receiving loop securely affixed to one of the first or second raised portions; and wherein the device cord spool is dimensioned and configured to permit a cord of the device to be wound around the central portion of the primary element while the device is inserted into the interior portion of the primary element, the cord secured by the strap, and an end of the cord to be secured by the cord end receiving loop.

14. The device cord spool of claim 13 in which all materials of the device cord spool are made of soft goods materials.

15. The device cord spool of claim 14 wherein the device is a charger plug.

16. The device cord spool of claim 15 further comprising a first cord end receiving loop securely affixed to the first raised portion of the primary element, wherein the first cord end receiving loop is dimensioned and configured to secure a first type of cord end; and a second cord end receiving loop securely affixed to the second raised portion of the primary element, wherein the second cord end receiving loop is dimensioned and configured to secure a second type of cord end.

* * * * *